US007172250B2

(12) United States Patent
Wu

(10) Patent No.: US 7,172,250 B2
(45) Date of Patent: Feb. 6, 2007

(54) ADJUSTABLE CHASSIS FOR CHAIR

(76) Inventor: Yao-Chuan Wu, 1-1, Neipuzai, Daqi Cun, Min Xiung Hsiang, Jiayi Hsien (TW)

( * ) Notice: Subject to any disclaimer, the term of this patent is extended or adjusted under 35 U.S.C. 154(b) by 291 days.

(21) Appl. No.: 10/951,114

(22) Filed: Sep. 27, 2004

(65) Prior Publication Data

US 2006/0071524 A1 Apr. 6, 2006

(51) Int. Cl.
*A47C 1/00* (2006.01)

(52) U.S. Cl. ..... 297/344.1; 297/344.13; 297/337

(58) Field of Classification Search ..... 297/344.1, 297/344.13, 337
See application file for complete search history.

(56) References Cited

U.S. PATENT DOCUMENTS 3,542,326 A * 11/1970 Reapsummer ..... 297/344.1
3,785,700 A * 1/1974 Kubo ..... 297/344.24
5,035,466 A * 7/1991 Mathews et al. ..... 297/337
5,259,257 A * 11/1993 Mouri ..... 248/429
5,320,373 A * 6/1994 Robertson et al. ..... 280/250.1
5,374,102 A * 12/1994 Archambault et al. . 297/344.13
5,584,460 A * 12/1996 Ropp ..... 248/423
5,871,198 A * 2/1999 Bostrom et al. ..... 248/588
6,036,267 A * 3/2000 Downey et al. ..... 297/341
6,886,843 B1 * 5/2005 Papac ..... 280/250.1
6,986,550 B2 * 1/2006 Gevaert et al. ..... 297/337

* cited by examiner

*Primary Examiner*—Peter M. Cuomo
*Assistant Examiner*—Erika Garrett
(74) *Attorney, Agent, or Firm*—Alan D. Kamrath; Nikolai & Mersereau, P.A.

(57) ABSTRACT

An adjustable chassis for a chair includes a base member, a support member, and two support levers. Thus, the drive lever of the base member is drawn and moved by the first wire so as adjust the height of the chair seat relative to the adjustable chassis. In addition, the locking plate of the base member is drawn and moved by the second wire so as adjust the inclined angle of the chair backrest relative to the adjustable chassis. Further, the locking block is drawn and moved by the third wire so as adjust the position of the chair seat relative to the adjustable chassis.

19 Claims, 9 Drawing Sheets

ADJUSTABLE CHASSIS FOR CHAIR

BACKGROUND OF THE INVENTION

1. Field of the Invention

The present invention relates to an adjustable chassis, and more particularly to an adjustable chassis for a chair.

2. Description of the Related Art

A conventional chair has a fixed structure that cannot be adjusted to fit a user's body ergonomically, so that the user easily feels uncomfortable when seated on the chair during a long period of time. In addition, the conventional chair has a fixed size and cannot be adjusted to fit statures of different users, thereby limiting the versatility of the conventional chair.

SUMMARY OF THE INVENTION

In accordance with the present invention, there is provided an adjustable chassis for a chair, comprising a base member, a support member, and two support levers, wherein:

the base member includes a housing having two sides each formed with a first pivot hole and a second pivot hole, a socket mounted in the housing, a bracket mounted on the socket, a drive lever pivotally mounted on the bracket and having an end drawn and moved by a first wire, a fixing seat mounted in the housing, a receiving seat mounted on the fixing seat, an inverted T-shaped locking plate movably mounted in the receiving seat and drawn and moved by a second wire;

the support member includes a board having two sides each formed with a pivot bore pivotally mounted on the first pivot hole of the housing of the base member by a pivot shaft and each formed with an elongated hole, and a locking seat fixed on a bottom of the board and formed with a plurality of locking grooves;

the locking plate of the base member is detachably locked in either one of the locking grooves of the locking seat of the support member, so that the support member is fixed on the base member;

each of the support levers has a first pivot hole pivotally mounted on the second pivot hole of the housing of the base member and a second pivot hole pivotally mounted on the elongated hole of the board of the support member, so that each of the support levers is pivotally mounted between the housing of the base member and the board of the support member.

The primary objective of the present invention is to provide an adjustable chassis for a chair, wherein the adjustable chassis has multiple adjusting functions, thereby enhancing the versatility of the adjustable chassis.

Another objective of the present invention is to provide an adjustable chassis for a chair, wherein the height of the chair seat relative to the adjustable chassis, the inclined angle of the chair backrest relative to the adjustable chassis and the position of the chair seat relative to the adjustable chassis are adjustable to fit a user's requirements.

A further objective of the present invention is to provide an adjustable chassis for a chair, wherein the drive lever of the base member is drawn and moved by the first wire so as adjust the height of the chair seat relative to the adjustable chassis.

A further objective of the present invention is to provide an adjustable chassis for a chair, wherein the locking plate of the base member is drawn and moved by the second wire so as adjust the inclined angle of the chair backrest relative to the adjustable chassis.

A further objective of the present invention is to provide an adjustable chassis for a chair, wherein the locking block is drawn and moved by the third wire so as adjust the position of the chair seat relative to the adjustable chassis.

Further benefits and advantages of the present invention will become apparent after a careful reading of the detailed description with appropriate reference to the accompanying drawings.

DETAILED DESCRIPTION OF THE INVENTION

Figure 1:
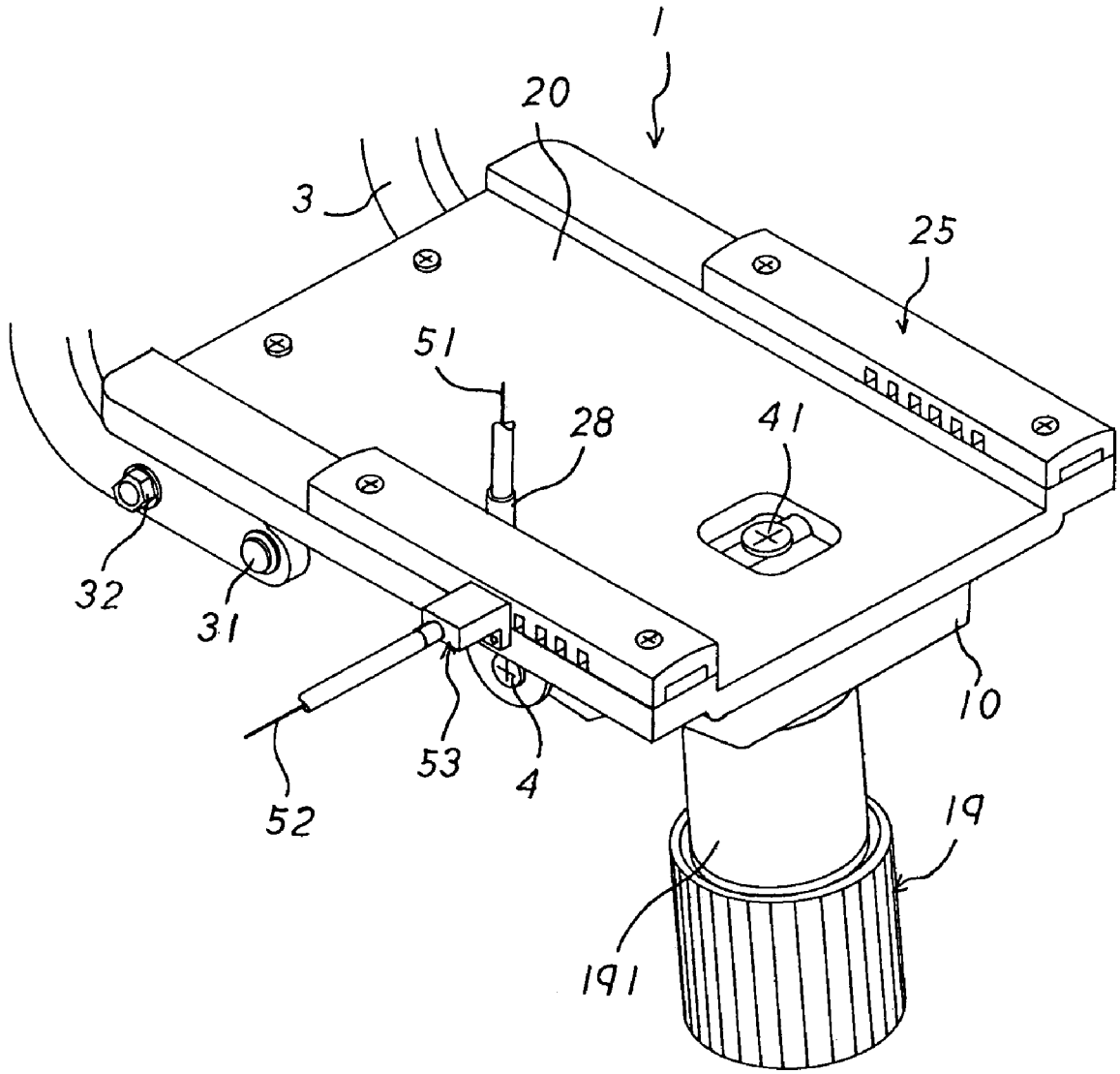
FIG. 1 is a partially cut-away perspective view of an adjustable chassis for a chair in accordance with the preferred embodiment of the present invention.
Figure 2:
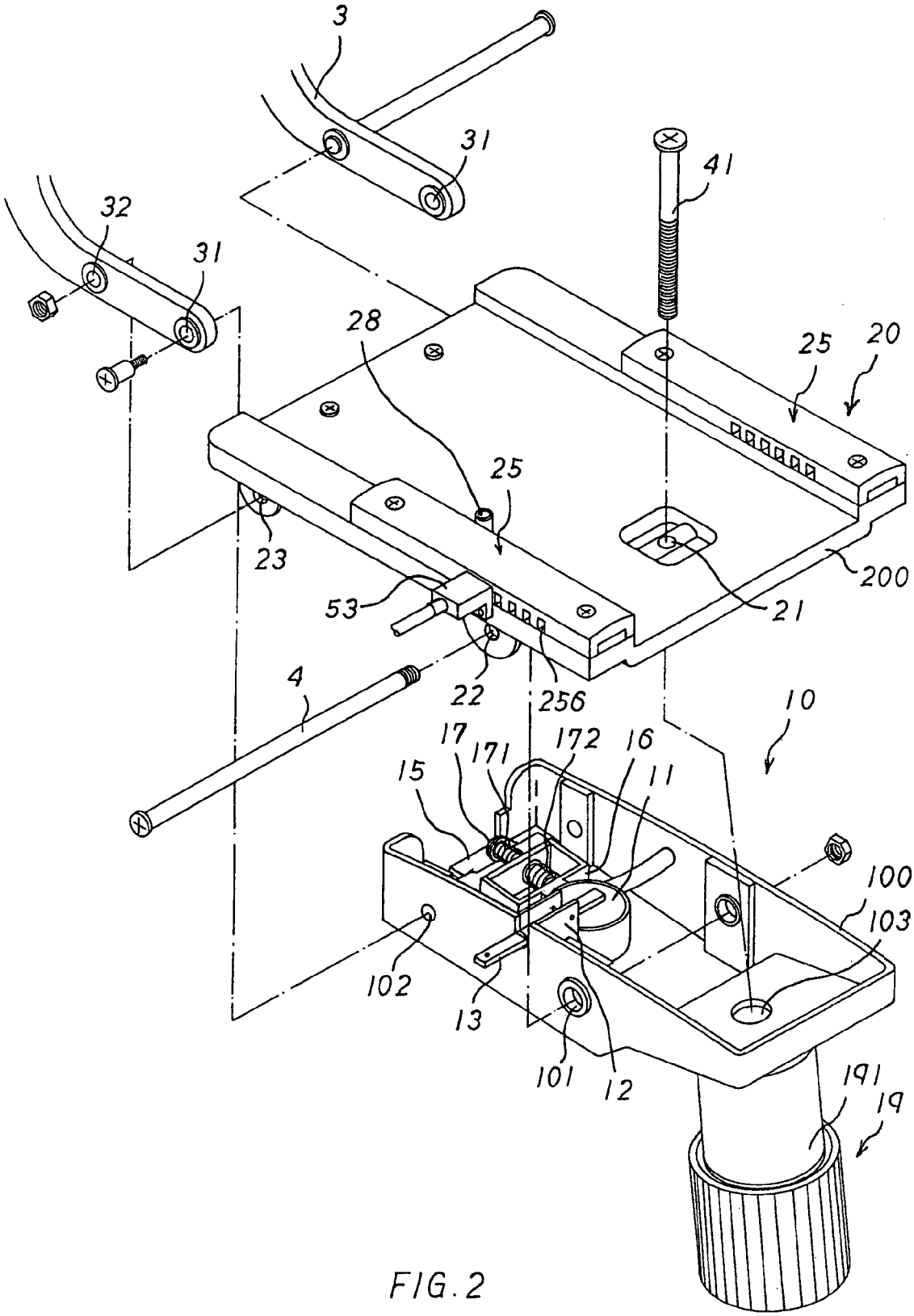
FIG. 2 is a partially exploded perspective view of the adjustable chassis for a chair FIG. 1.
Figure 3:
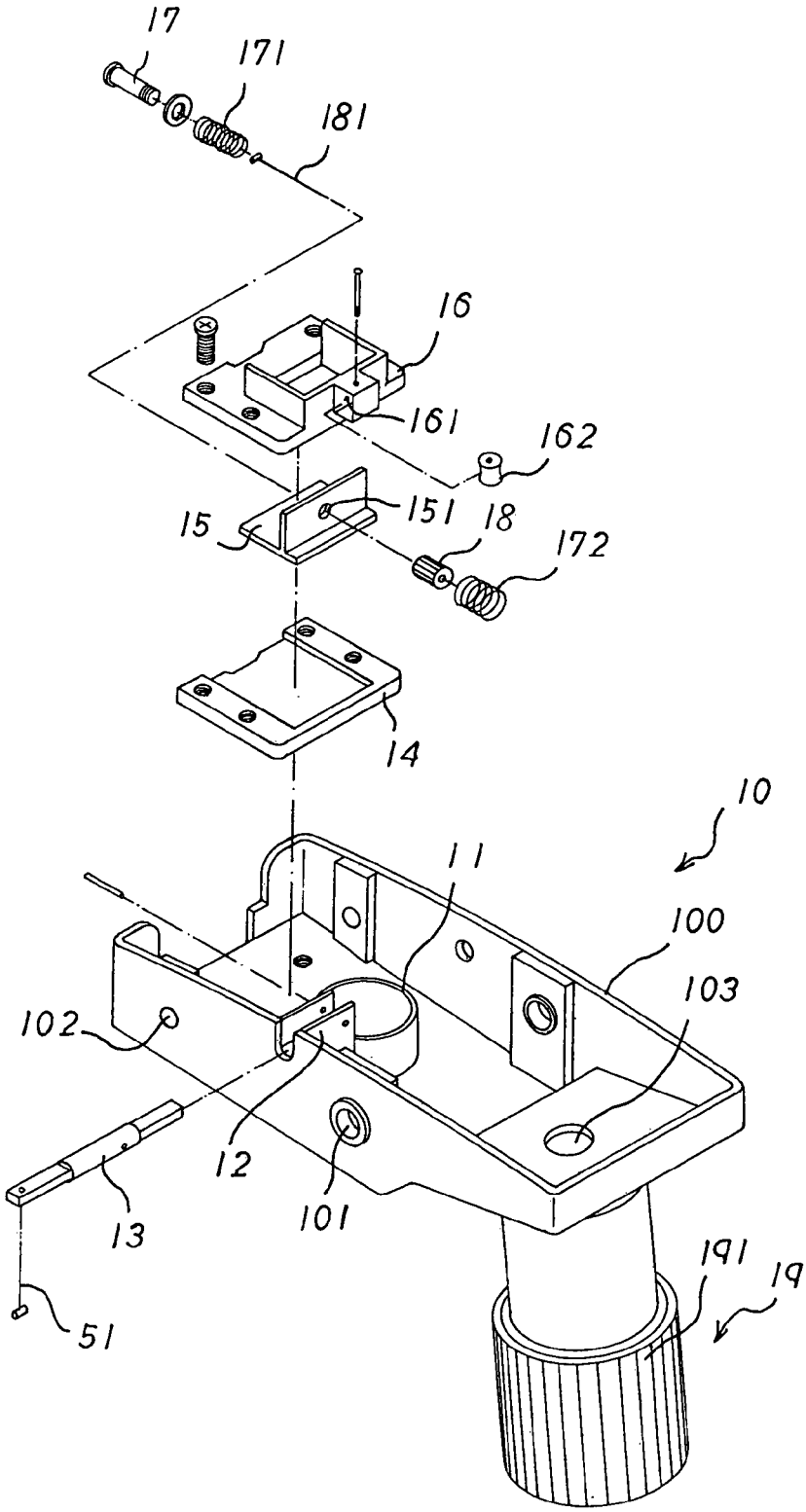
FIG. 3 is a partially exploded perspective view of the adjustable chassis for a chair FIG. 1.
Figure 4:
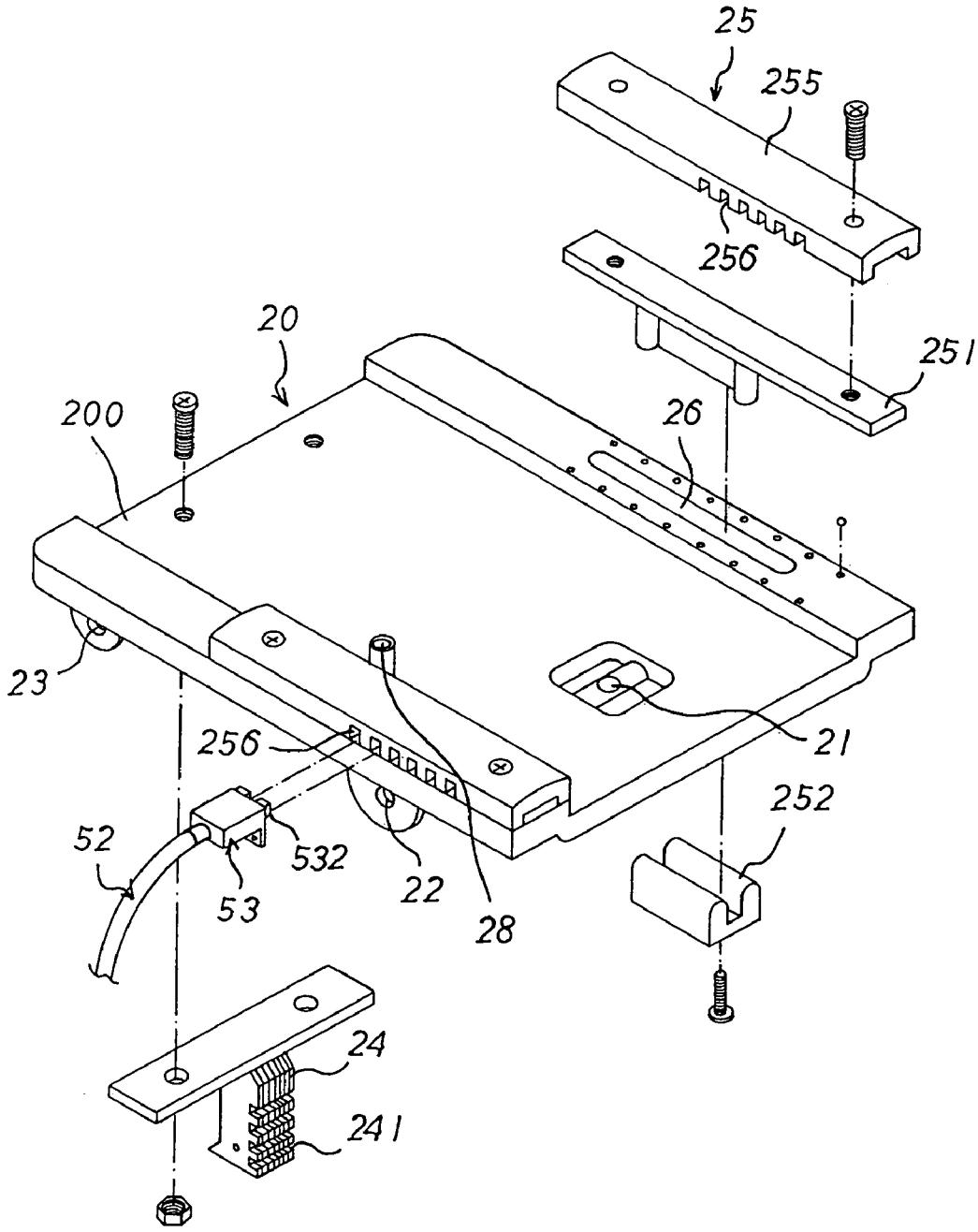
FIG. 4 is a partially exploded perspective view of the adjustable chassis for a chair FIG. 1.
Figure 5:
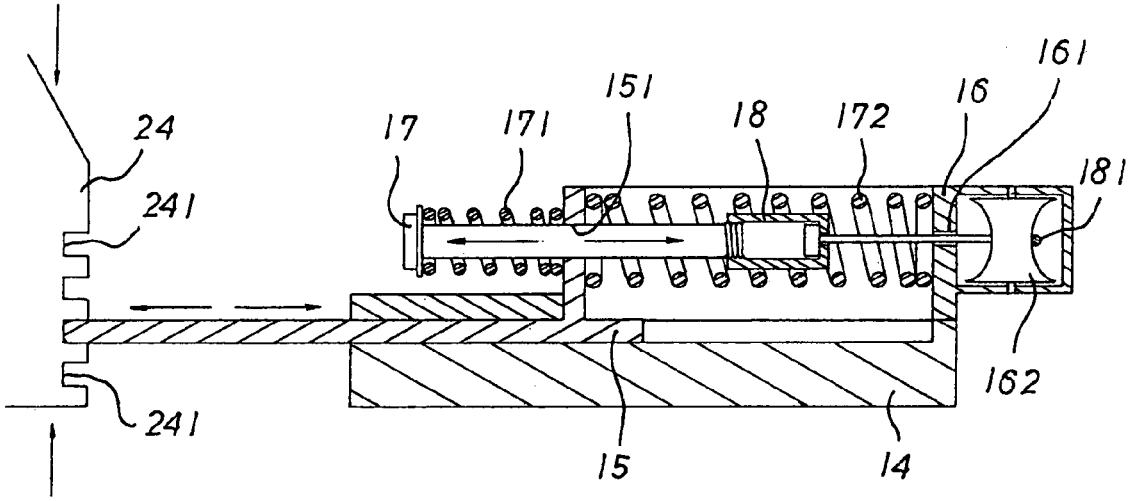
FIG. 5 is a side plan cross-sectional view of the adjustable chassis for a chair as shown in FIG. 1.

Referring to the drawings and initially to FIGS. 1–5, an adjustable chassis 1 for a chair in accordance with the preferred embodiment of the present invention comprises a base member 10, and a support member 20 mounted on the base member 10.

The base member 10 includes a housing 100 having two sides each formed with a first pivot hole 101 and a second pivot hole 102, a socket 11 mounted in the housing 100, a bracket 12 mounted on the socket 11, a drive lever 13 pivotally mounted on the bracket 12 and having a first end secured on a pneumatic bar (not shown) mounted in the socket 11 to lift or lower the pneumatic bar and a second end drawn and moved by a first wire 51, a fixing seat 14 mounted in the housing 100, a receiving seat 16 mounted on the fixing seat 14, an inverted T-shaped locking plate 15 movably mounted in the receiving seat 16 and drawn and moved by a second wire 181.

The base member 10 further includes a threaded shaft 17 extended through a hole 151 of a vertical wall of the locking plate 15, a threaded sleeve 18 screwed onto a first end of the threaded shaft 17, a first spring 171 urged between the vertical wall of the locking plate 15 and a second end of the threaded shaft 17, a second spring 172 urged between the vertical wall of the locking plate 15 and the receiving seat 16, and a roller 162 mounted in the receiving seat 16. The second wire 181 is extended through the roller 162 and a hole 161 of the receiving seat 16 and has an end fixed on the threaded sleeve 18.

The support member 20 is combined with a chair seat (not shown) and includes a board 200 having two sides each formed with a pivot bore 22 pivotally mounted on the first pivot hole 101 of the housing 100 of the base member 10 by a pivot shaft 4 and each formed with an elongated hole 23, and a locking seat 24 fixed on a bottom of the board 200 and formed with a plurality of locking grooves 241, and the locking plate 15 of the base member 10 is detachably locked in either one of the locking grooves 241 of the locking seat 24 of the support member 20, so that the support member 20 is fixed on the base member 10. A conducting tube 28 is mounted on the board 200 of the support member 20 to receive the first wire 51.

The support member 20 further includes two slides 25 each slidably mounted on the board 200 and each including a slide plate 251 slidably mounted in a guide slot 26 of the board 200 and limited by a U-shaped limit seat 252, and a cap 255 fixed on the slide plate 251 and formed with a plurality of locking recesses 256, a mounting seat 53 mounted on the board 200, a locking block 532 movably mounted in the mounting seat 53 and having a first end detachably locked in either one of the locking recesses 256 of the cap 255 of one of the two slides 25 to fix the slides 25 on the board 200 and a second end drawn and moved by a third wire 52, and a spring 531 (see FIG. 7) mounted in the mounting seat 53 and urged on the locking block 532 to push the locking block 532 toward the slides 25. The chair seat is fixed on the slides 25 to move therewith.

The housing 100 of the base member 10 has an end formed with a through hole 103, the board 200 of the support member 20 has an end formed with a through hole 21, and the adjustable chassis 1 further comprises a threaded rod 41 extended through the through hole 21 of the board 200 and the through hole 103 of the housing 100 of the base member 10 and screwed into an elastic adjusting member 191 to form an adjusting unit 19.

The adjustable chassis 1 further comprises two support levers 3 combined with a chair backrest (not shown) and each having a first pivot hole 31 pivotally mounted on the second pivot hole 102 of the housing 100 of the base member 10 and a second pivot hole 32 pivotally mounted on the elongated hole 23 of the board 200 of the support member 20, so that each of the two support levers 3 is pivotally mounted between the housing 100 of the base member 10 and the board 200 of the support member 20.

In operation, the drive lever 13 of the base member 10 is drawn and moved by the first wire 51 to press the pneumatic bar mounted in the socket 11 to lift or lower the pneumatic bar so as to adjust the height of the chair seat relative to the adjustable chassis 1.

Alternatively, the locking plate 15 of the base member 10 is drawn and moved by the second wire 181 to detach from the respective locking groove 241 of the locking seat 24 of the support member 20, thereby detaching the support member 20 from the base member 10, so that the support member 20 is pivoted relative to the base member 10 and has a cushioning effect by the adjusting unit 19. At this time, each of the two support levers 3 is pivotally mounted between the base member 10 and the support member 20, so that each of the two support levers 3 is pivoted relative to the base member 10 by the pivot action of the support member 20 so as to adjust the inclined angle of the chair backrest relative to the adjustable chassis 1.

Alternatively, the locking block 532 is drawn and moved by the third wire 52 to detach from the respective locking recess 256 of the cap 255 of the respective slide 25, thereby detaching the slides 25 from the board 200, so that the slides 25 are movable relative to the board 200 to move the chair seat relative to the board 200 so as to adjust the position of the chair seat relative to the adjustable chassis 1.

Accordingly, the drive lever 13 of the base member 10 is drawn and moved by the first wire 51 so as adjust the height of the chair seat relative to the adjustable chassis 1. In addition, the locking plate 15 of the base member 10 is drawn and moved by the second wire 181 so as adjust the inclined angle of the chair backrest relative to the adjustable chassis 1. Further, the locking block 532 is drawn and moved by the third wire 52 so as adjust the position of the chair seat relative to the adjustable chassis 1.

Figure 6:
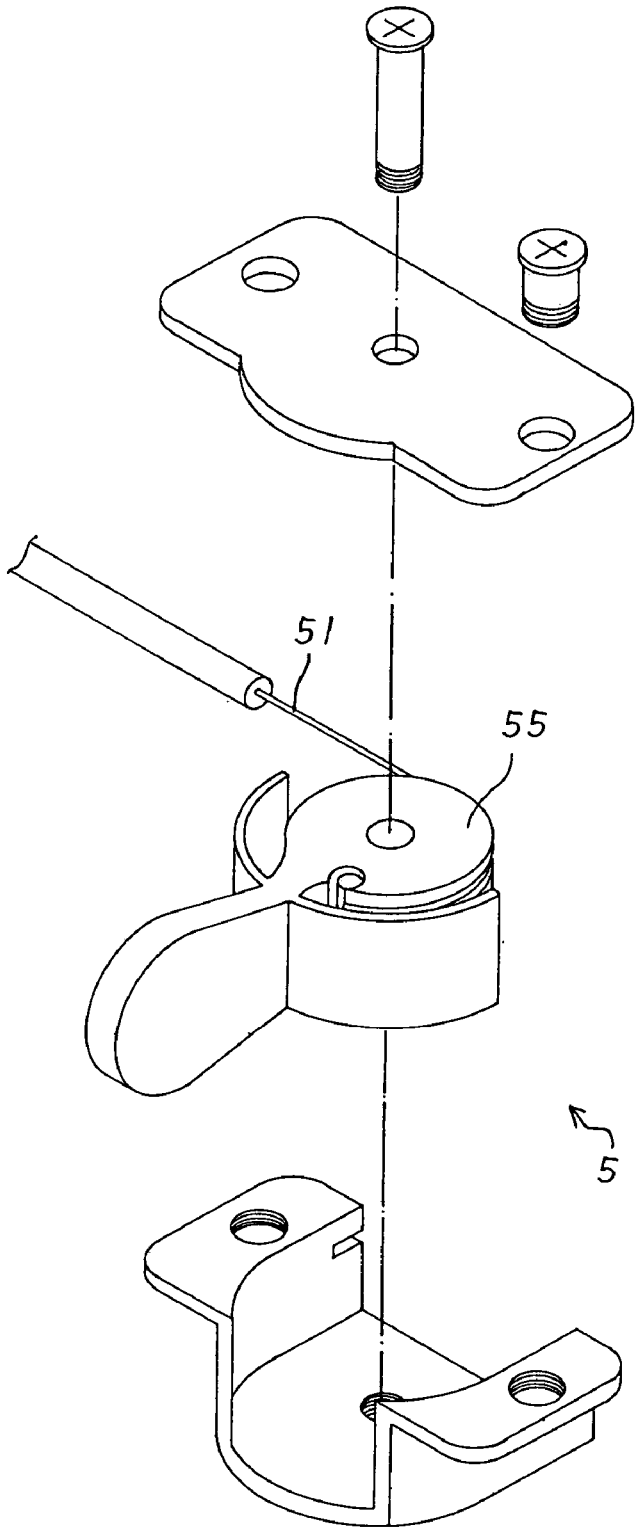
FIG. 6 is an exploded perspective view of an adjuster of the adjustable chassis for a chair in accordance with the preferred embodiment of the present invention.

Referring to FIG. 6, the first wire 51 is drawn and moved by a reciprocating adjuster 5 having a rotation shaft 55 for mounting the first wire 51. Preferably, the reciprocating adjuster 5 is mounted on a proper position of the adjustable chassis 1.

Figure 7:
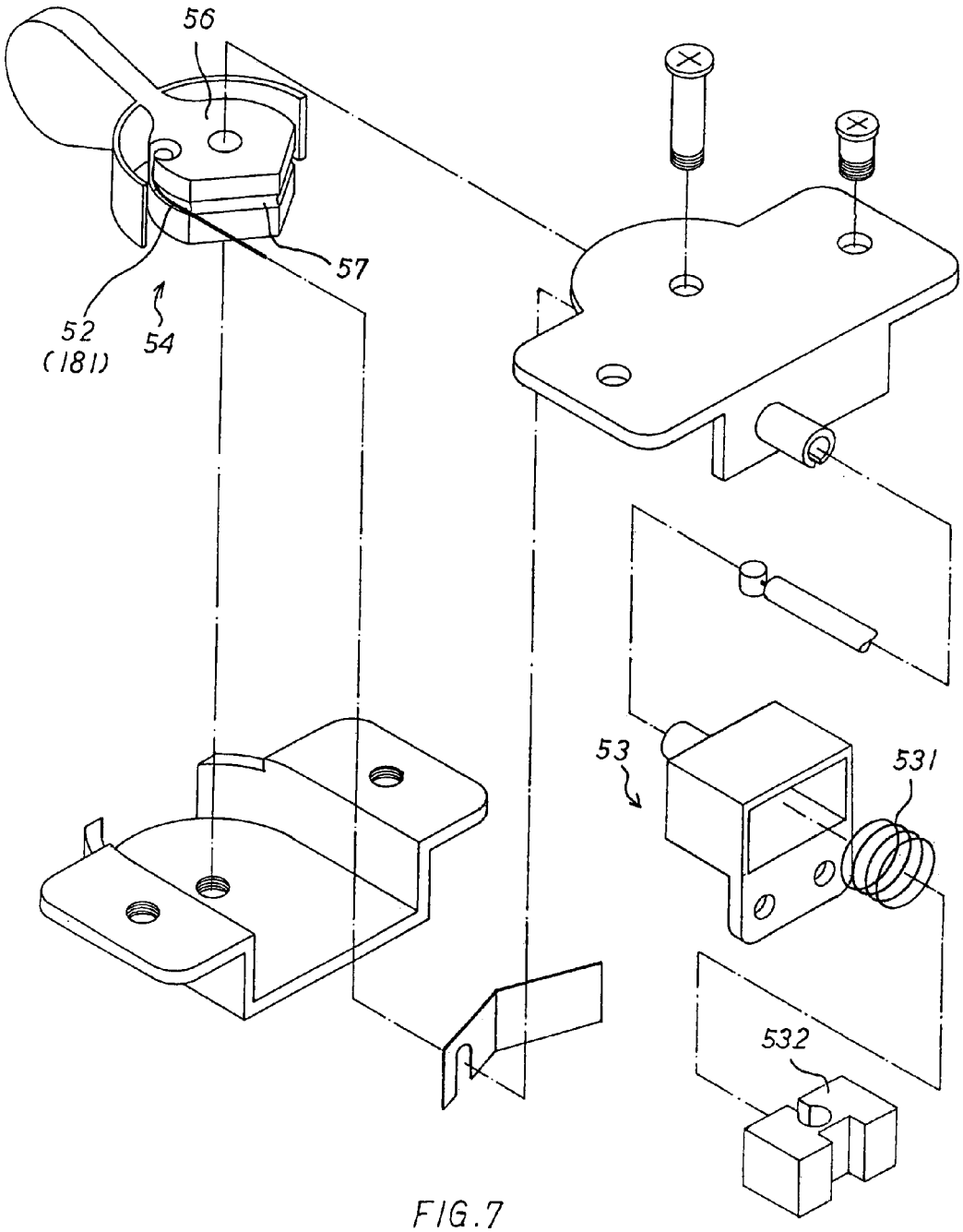
FIG. 7 is an exploded perspective view of an adjuster of the adjustable chassis for a chair in accordance with the preferred embodiment of the present invention.

Referring to FIG. 7, each of the second wire 181 and the third wire 52 is drawn and moved by a reciprocating adjuster 54 having a rotation shaft 56 for mounting the second wire 181 or the third wire 52. The rotation shaft 56 of the reciprocating adjuster 54 has a retaining groove 57 for retaining the second wire 181 or the third wire 52. Preferably, the reciprocating adjuster 54 is mounted on a proper position of the adjustable chassis 1.

Figure 8:
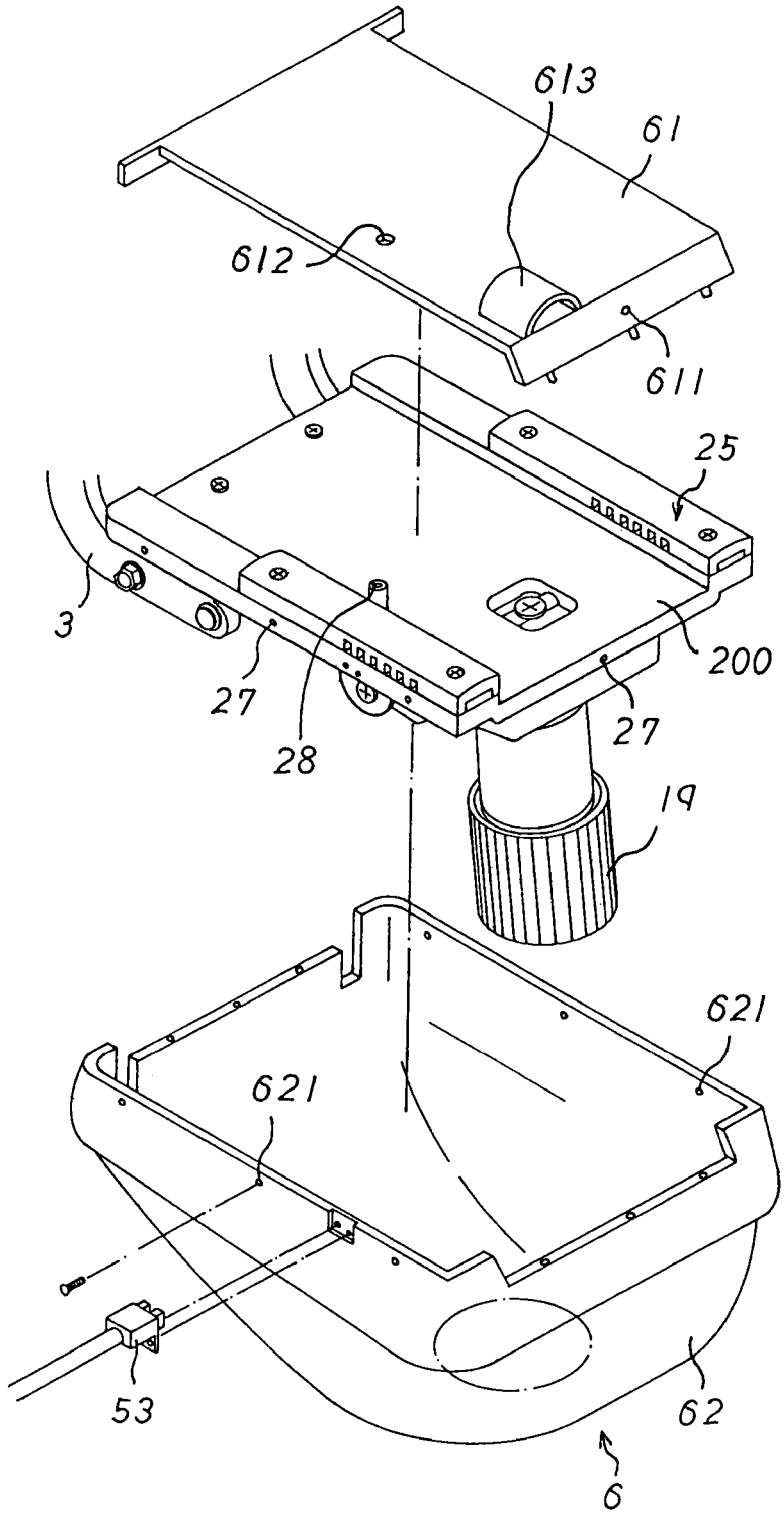
FIG. 8 is a partially exploded perspective view of an adjustable chassis for a chair in accordance with another embodiment of the present invention.

Referring to FIG. 8, the adjustable chassis 1 further comprises a casing 6 including a first shell 61 mounted on the board 200 of the support member 20 and having a hole 612 and a conduit 613 for passage of the first wire 51, and a second shell 62 mounted on the board 200 of the support member 20 and combined with the first shell 61. The mounting seat 53 of the support member 20 is mounted on the second shell 62 of the casing 6. The support member 20 has a periphery formed with a plurality of screw bores 27, the first shell 61 of the casing 6 has a periphery formed with a plurality of fixing holes 611 fixed on the respective screw bores 27 of the support member 20, and the second shell 62 of the casing 6 has a periphery formed with a plurality of fixing holes 611 fixed on the respective screw bores 27 of the support member 20.

Figure 9:
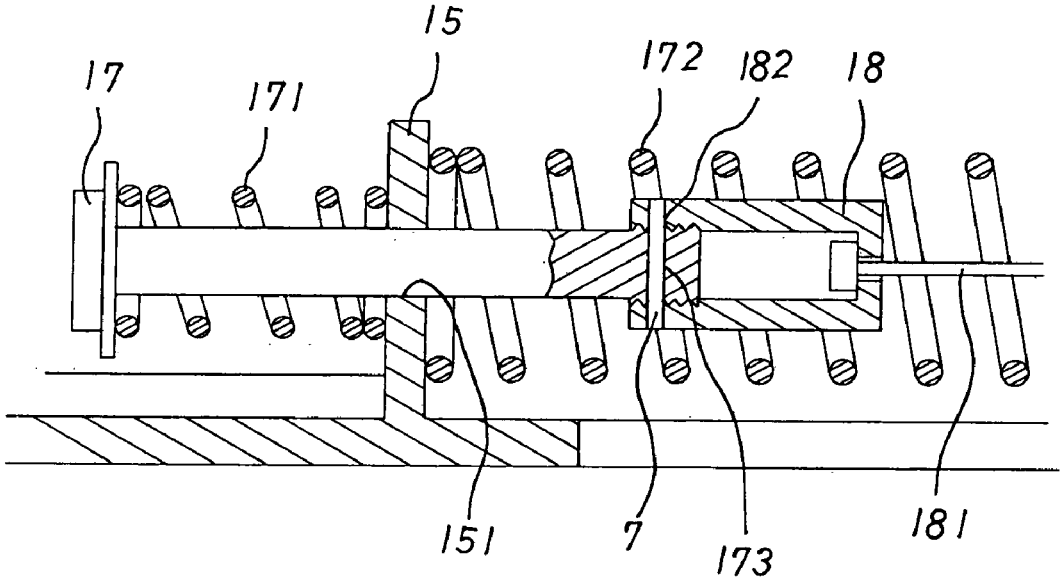
FIG. 9 is a partially side plan cross-sectional view of an adjustable chassis for a chair in accordance with another embodiment of the present invention.

Referring to FIG. 9, the threaded sleeve 18 is formed with a first pin hole 182, the threaded shaft 17 is formed with a second pin hole 173, and the adjustable chassis 1 further comprises a fixing pin 7 extended through the first pin hole 182 of the threaded sleeve 18 and the second pin hole 173 of the threaded shaft 17, so that the threaded sleeve 18 is fixed on the threaded shaft 17.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An adjustable chassis for a chair, comprising a base member, a support member, and two support levers, wherein:

the base member includes a housing having two sides each formed with a first pivot hole and a second pivot hole, a socket mounted in the housing, a bracket mounted on the socket, a drive lever pivotally mounted on the bracket and having an end drawn and moved by a first wire, a fixing seat mounted in the housing, a receiving seat mounted on the fixing seat, an inverted T-shaped locking plate movably mounted in the receiving seat and drawn and moved by a second wire;

the support member includes a board having two sides each formed with a pivot bore pivotally mounted on the first pivot hole of the housing of the base member by a pivot shaft and each formed with an elongated hole, and a locking seat fixed on a bottom of the board and formed with a plurality of locking grooves;

the locking plate of the base member is detachably locked in either one of the locking grooves of the locking seat of the support member, so that the support member is fixed on the base member;

each of the support levers has a first pivot hole pivotally mounted on the second pivot hole of the housing of the base member and a second pivot hole pivotally mounted on the elongated hole of the board of the support member, so that each of the support levers is pivotally mounted between the housing of the base member and the board of the support member.

2. The adjustable chassis in accordance with claim 1, wherein the base member further includes a threaded shaft extended through a hole of a vertical wall of the locking plate, a threaded sleeve screwed onto a first end of the threaded shaft, a first spring urged between of the vertical wall of the locking plate and a second end of the threaded shaft, a second spring urged between the vertical wall of the locking plate and the receiving seat, and a roller mounted in the receiving seat.

3. The adjustable chassis in accordance with claim 1, wherein the second wire is extended through the roller and a hole of the receiving seat and has an end fixed on the threaded sleeve.

4. The adjustable chassis in accordance with claim 1, wherein the support member further includes a conducting tube mounted on the board to receive the first wire.

5. The adjustable chassis in accordance with claim 1, wherein the support member further includes a mounting seat mounted on the board, a locking block movably mounted in the mounting seat and drawn and moved by a third wire, and two slides each slidably mounted on the board and each detachably locked by the locking block.

6. The adjustable chassis in accordance with claim 5, wherein each of the slides includes a slide plate slidably mounted in a guide slot of the board and limited by a U-shaped limit seat, and a cap fixed on the slide plate and formed with a plurality of locking recesses, and the locking block has a first end detachably locked in either one of the locking recesses of the cap of one of the two slides to fix the slides on the board and a second end drawn and moved by the third wire.

7. The adjustable chassis in accordance with claim 5, wherein the support member further includes a spring mounted in the mounting seat and urged on the locking block to push the locking block toward the slides.

8. The adjustable chassis in accordance with claim 5, wherein the third wire is drawn and moved by a reciprocating adjuster having a rotation shaft for mounting the third wire.

9. The adjustable chassis in accordance with claim 8, wherein the rotation shaft of the reciprocating adjuster has a retaining groove for retaining the third wire.

10. The adjustable chassis in accordance with claim 8, wherein the reciprocating adjuster is mounted on a proper position of the adjustable chassis.

11. The adjustable chassis in accordance with claim 1, wherein the housing of the base member has an end formed with through hole, the board of the support member has an end formed with through hole, and the adjustable chassis further comprises a threaded rod extended through the through hole of the board and the through hole of the housing of the base member and screwed into an elastic adjusting member to form an adjusting unit.

12. The adjustable chassis in accordance with claim 1, wherein the first wire is drawn and moved by a reciprocating adjuster having a rotation shaft for mounting the first wire.

13. The adjustable chassis in accordance with claim 12, wherein the reciprocating adjuster is mounted on a proper position of the adjustable chassis.

14. The adjustable chassis in accordance with claim 1, wherein the second wire is drawn and moved by a reciprocating adjuster having a rotation shaft for mounting the second wire.

15. The adjustable chassis in accordance with claim 11, wherein the rotation shaft of the reciprocating adjuster has a retaining groove for retaining the second wire.

16. The adjustable chassis in accordance with claim 14, wherein the reciprocating adjuster is mounted on a proper position of the adjustable chassis.

17. The adjustable chassis in accordance with claim 1, further comprising a casing including a first shell mounted on the board of the support member and having a hole and a conduit for passage of the first wire, and a second shell mounted on the board of the support member and combined with the first shell.

18. The adjustable chassis in accordance with claim 1, wherein the support member has a periphery formed with a plurality of screw bores, the first shell of the casing has a periphery formed with a plurality of fixing holes fixed on the respective screw bores of the support member, and the second shell of the casing has a periphery formed with a plurality of fixing holes fixed on the respective screw bores of the support member.

19. The adjustable chassis in accordance with claim 1, wherein the threaded sleeve is formed with a first pin hole, the threaded shaft is formed with a second pin hole, and the adjustable chassis further comprises a fixing pin extended through the first pin hole of the threaded sleeve and the second pin hole of the threaded shaft, so that the threaded sleeve is fixed on the threaded shaft.

* * * * *